United States Patent [19]

Zellner

[11] Patent Number: 4,592,099

[45] Date of Patent: Jun. 3, 1986

[54] TILTABLE BATHTUB FOR INVALIDS

[76] Inventor: John R. Zellner, 839 E. University Ave., Auburn, Ala. 36830

[21] Appl. No.: 638,030

[22] Filed: Aug. 6, 1984

[51] Int. Cl.[4] ..... A47K 3/022

[52] U.S. Cl. ..... 4/540; 4/574; 4/575; 4/578

[58] Field of Search ..... 4/540, 550, 554, 560, 4/571, 573–575, 578

[56] References Cited

U.S. PATENT DOCUMENTS

| | | | |
|---|---|---|---|
| 424,730 | 4/1890 | Schoonmaker | 4/578 X |
| 2,536,540 | 1/1951 | Davis | 4/176 |
| 3,174,160 | 3/1965 | Fielding | 4/176 |
| 3,534,748 | 10/1970 | Ekman | 134/118 |
| 3,641,596 | 2/1972 | Bill | 4/173 |
| 3,889,304 | 6/1975 | Loren | 4/578 X |
| 4,034,424 | 7/1977 | Budlong | 4/173 |
| 4,099,272 | 7/1978 | Sowder | 4/148 |
| 4,099,273 | 7/1978 | Colby | 4/540 |
| 4,197,838 | 4/1980 | Shill | 128/66 |
| 4,280,234 | 7/1981 | Sax | 4/540 |
| 4,296,508 | 10/1981 | Moran | 4/540 |
| 4,530,121 | 7/1985 | Penney | 4/540 |

*Primary Examiner*—Charles E. Phillips

*Attorney, Agent, or Firm*—Robert J. Zellner

[57] ABSTRACT

A tiltable bathtub for easy access by the bather without assistance in which the tub is pivotably supported on a horizontal pivot near the tub rim, the pivot axis being either lengthwise of the tub and on the longitudinal centerline of the tub rim or transverse to the length of the tub and midway of the ends of the tub, a bath support platform within the tub being independently supported and adapted for easy cleaning.

5 Claims, 9 Drawing Figures

TILTABLE BATHTUB FOR INVALIDS

TECHNICAL FIELD OF THE INVENTION

This invention is in the field of bathtubs and particularly bathtubs designed to facilitate the safe entry and egress of the bather.

DESCRIPTION OF THE RELATED ART

Traditional bathtubs require the user to climb into and out of a wet, slippery hole. The balancing act of standing on one leg to step over a thirteen inch barrier is inconvenient for young and old alike as well as being dangerous at times. Adaptive equipment like grab bars give support and help in maintaining balance, but one must still raise one's entire weight up out of a hole. Showering eliminates the shifting of weight but still requires standing on a wet, potentially slippery surface.

Several attempts have been made to provide safe bathtubs for the weak and elderly. Amongst them is the tub of Colby, U.S. Pat. No. 4,099,273, in which a cylindrical tub can be rolled on arcuate tracks about a center top longitudinal axis. A bather support floor is anchored against tipping by arcuate arms attached to a tub support housing and extended over the back side of the tub into the tub. The tub, which is supported on ball bearings in arcuate tracks in the support housing, can be rolled closed for bathing by a hand crank and chain drive operated by an assistant at one end. The bather support floor rides on ball bearings carried by the tub on its interior. Another arcuate arm hung over the backwall into the tub has a series of holes in it to allow locking the tub at various angles. These multiple tracks and bearings require accurate and expensive assembly if, indeed, they could be assembled as shown.

The bathtub according to Davis, U.S. Pat. No. 2,530,540 can be tipped from a position where the tub floor is vertical to the horizontal about a transverse pivot below the tub floor and about 40% of the tub length from its foot. A screw or hydraulic jack beneath the tub is used to tip the tub. A similar tub is shown in Fielding, U.S. Pat. No. 3,174,160 having the transverse pivot at the foot of the tub, a hydraulic jack system for tilting the tub, and hose connections to the plumbing.

Tubs with gated sides of various designs are shown in U.S. Pat. Nos. 4,034,424 to Budlong; 4,099,272 to Sowder and 4,296,508 to Moran. These arrangements present obvious sealing problems.

In U.S. Pat. No. 3,641,596 to Bill and 4,280,234 to Sax, a bather's chair is provided to support the bather while in the tub. He can enter the chair when the tub is empty and swung out from under the chair. The chair is supported in cantilever from the top back so that when the bather has sat down on the chair, the tub can be swung under the chair and around the chair as it is supported pivotally on an upright. The pivot is off-center and in some cases closely adjacent to one sidewall of the tube so that when the tub is swung closed around the seated bather for filling, a minimum of tub space need be filled around him. An assistant is required to swing the tub into and out of position around the bather.

Inventor Ekman in U.S. Pat. No. 3,534,748 has a tilt-tub arrangement very similar to those of Bill and Sax in which the tub pivot is at the upper edge of one sidewall of the tub except that the bather is supported in a near supine position on a bath stretcher which is placed on bent arms allowing the tub to be swung under and around the stretcher.

BRIEF SUMMARY OF THE INVENTION

The primary object of this invention is to make it possible and safe for weak or disabled persons to enter a bathtub without assistance, bathe themselves in that tub, and following bathing, to safely get out of the bathtub unaided.

Another object of this invention is to provide a bathtub which may be easily tilted into open position for entry before bathing, tilted by the bather to a closed position while inside the tub on a body support and easily tilted back into an open position for getting out of the tub following bathing, also unaided by another.

A further object is to support the bather in a movable tub, but separately from it.

Another object of this invention is to provide a tiltable bathtub with a fixed body support so designed that the tub and body support may be easily cleaned.

These and other objects of the invention are achieved by providing a bathing device having a tub which may be tilted about a horizontal axis to raise and lower one side for safe and easy access by the bather comprising a bathtub having two upstanding walls, pivot supports for said walls, the pivot axis being above the center of gravity and generally in the vertical plane through the center of gravity when the tub is level and a body rest platform within the tub adjacent to and supported above the bottom of the tub, clear of the tub walls and bottom.

In one embodiment the bathing device may include at least one upright member to locate the pivots in position to support the walls and an arm extending from said upright to support the body rest.

In a preferred embodiment the bathing device includes a semi-cylindrical wall joining the opposed upstanding walls in watertight relation. The upstanding walls are the ends of the tub.

In a more preferred embodiment the bathing device of the tub is generally in the shape of a long semi-cylinder and the pivot axis is substantially co-axial with the cylinder from which the semi-cylinder was generated whereby the distance between the body rest platform and the inside surface of the tub remains nearly constant throughout the tilting of the tub.

In another embodiment the upstanding walls are the sides of the tub.

In a preferred embodiment the rest platform comprises a head portion and a foot portion electively joined where adjacent, said portions each being supported with a hinge to enable the portions of the rest platform to be separated and raised for cleaning.

In use of this invention the bather, even an invalid, can enter from one side or end, sit on a body support surface which is firm and fixed, unlatch the tub, manually tilt the tub to raise the lowered side or end into the bathing position and latch it in that position before filling the tub. In the tub of this invention, the tub is supported on a horizontal axis by a pair of pivots and bearings. These pivots may be supported by columns attached to a base or floor under the tub. Also supported by the columns is the body support. While the tub walls are raised and lowered by tilting the tub for entrance and exit of the bather, only smooth surfaces slide past the body support and the rising wall is clear of any overhanging body supports to possibly injure the bather.

DETAILED DESCRIPTION OF THE INVENTION

Figure 1:
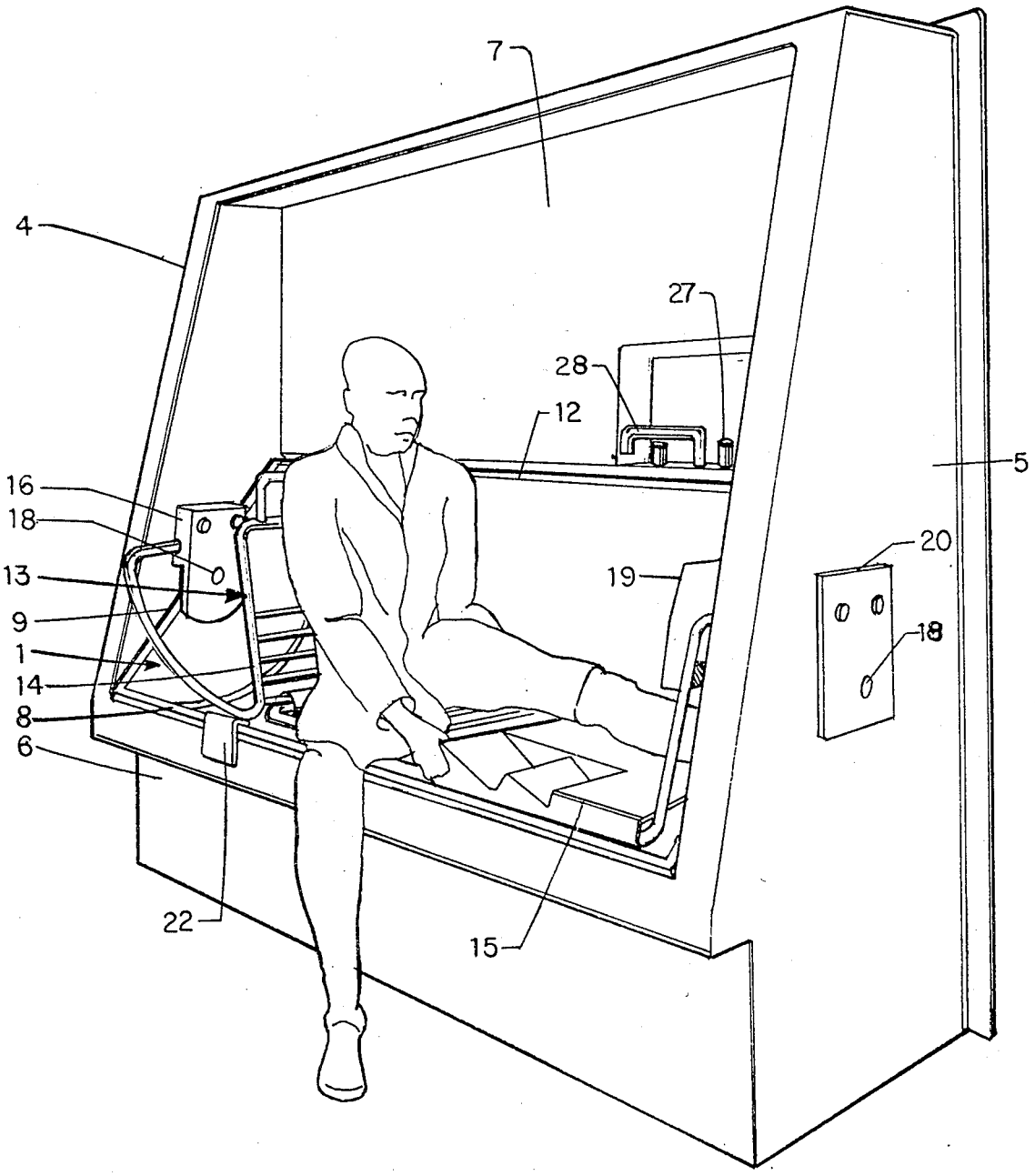
FIG. 1 is a perspective of a preferred form of the bathing device of my invention having the tub pivots at the tub ends and showing the tub side lowered with a bather sitting on the body support platform with his legs over the edge of the tub prior to placing his feet and legs on the body support.
Figure 2:
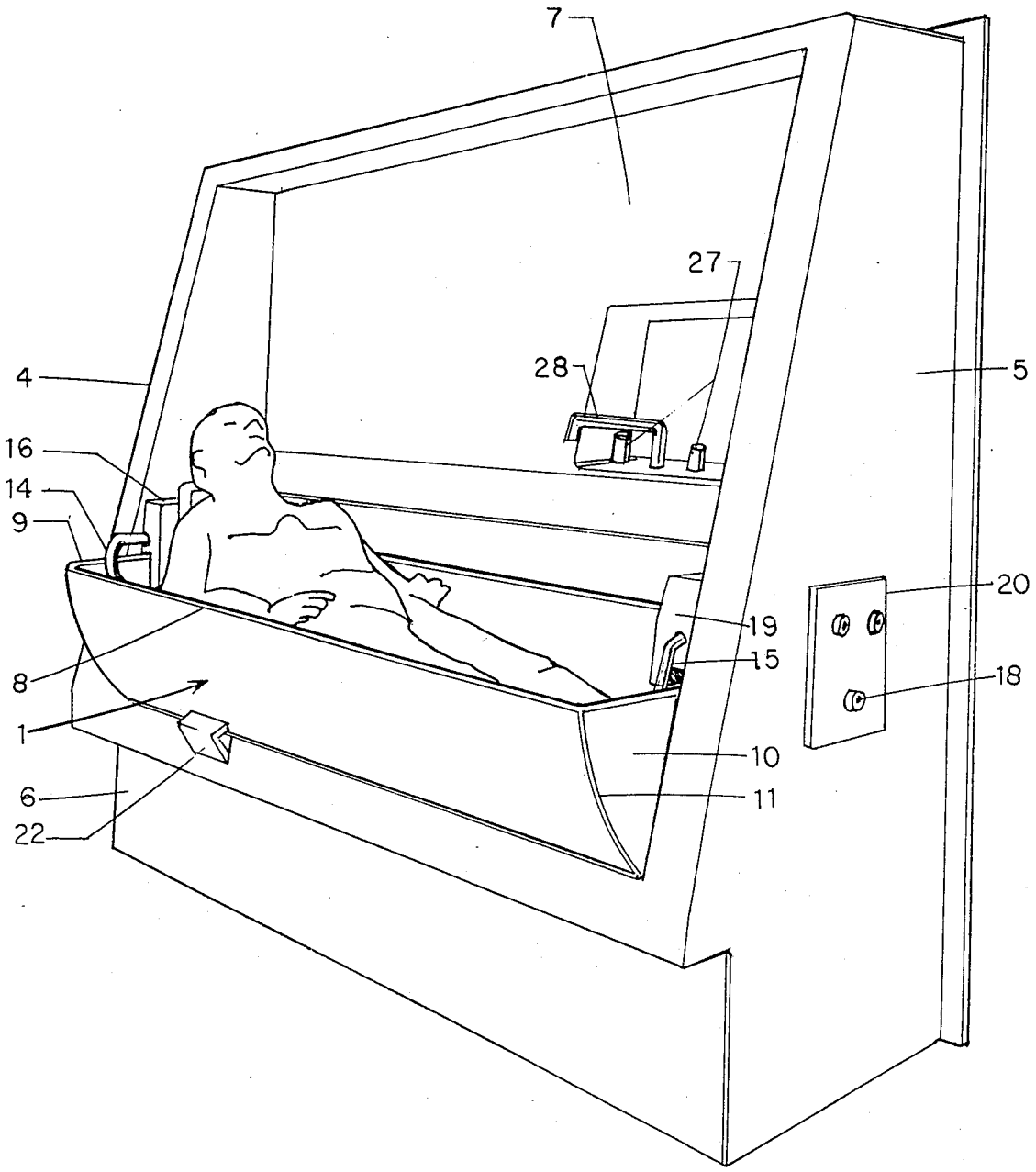
FIG. 2 is a perspective of the bathing device of FIG. 1 with the tub side raised for filling and showing the bather in a reclining position on the platform within the tub.
Figure 3:
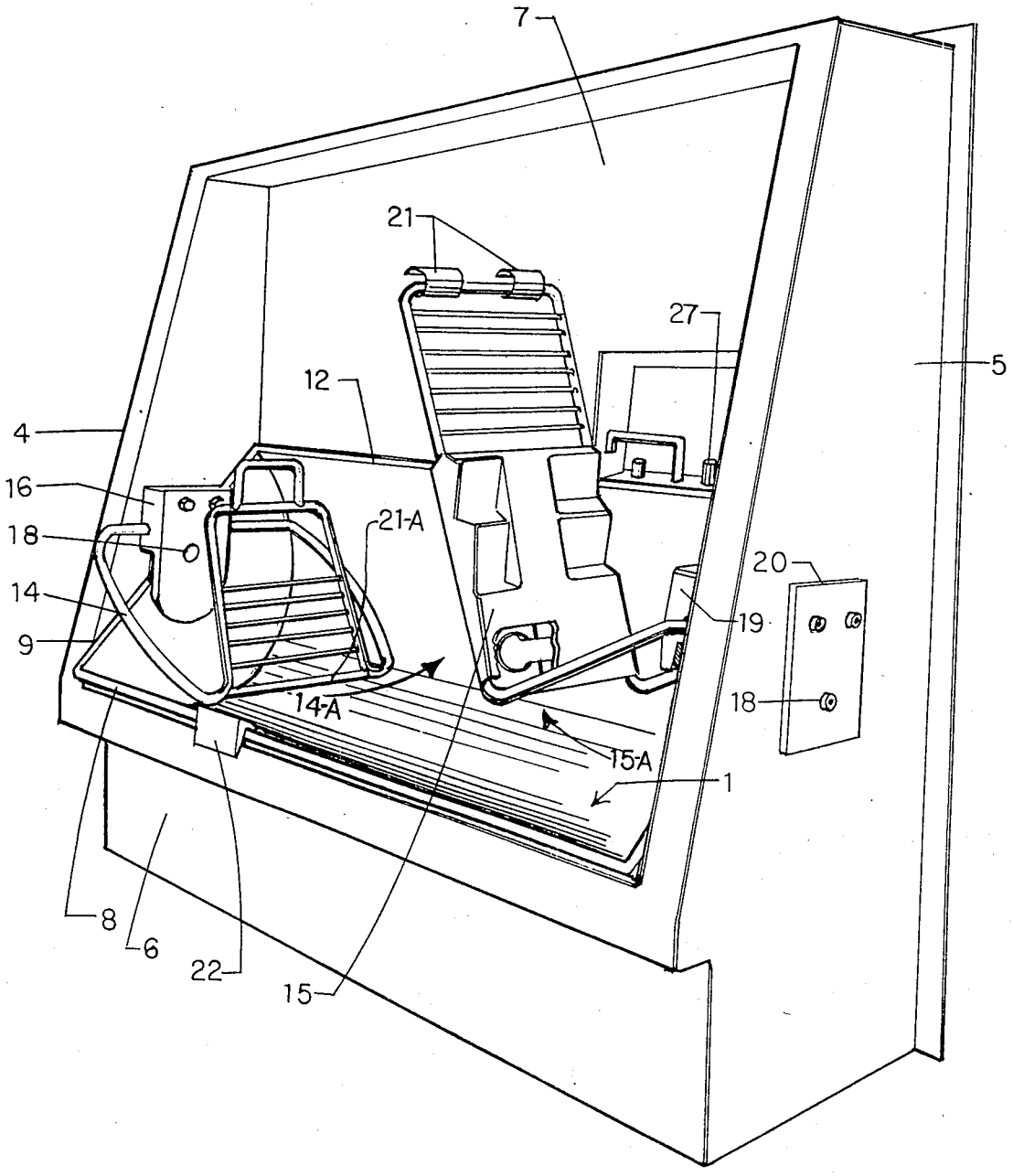
FIG. 3 is another perspective of the bathing device of FIGS. 1 and 2 showing details of the body rest platform with the foot end of the platform swung up for cleaning.
Figure 4:
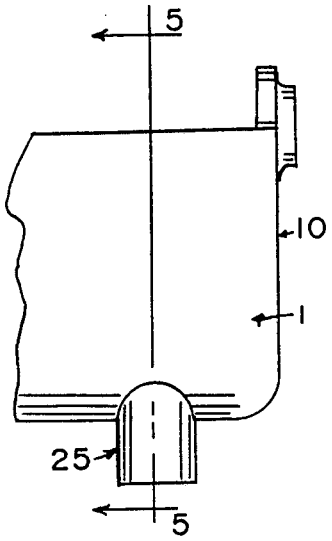
FIG. 4 is an elevation of the right hand side of the foot of the tub of FIGS. 1–3.

As shown in FIGS. 1–6, a preferred embodiment of the bathing device of my invention has a semi-cylindrical tub 1 supported by horizontal co-axial pivots 2 and 3 on uprights 4 and 5 at each end of the tub 1. The uprights 4 and 5 may be joined by a common base (not shown) or bolted directly to a floor upon installation. The uprights 4 and 5 may also be joined by a front wall 6 and a back wall 7 to form a cabinet as seen in FIGS. 1–3. This cabinet is useful in controlling water splashed during bathing.

The pivots 2 and 3 are best located as in this preferred embodiment near the tub rim 8 on the tub ends 9 and 10 midway between the sides 11 and 12. A body rest platform 13 is composed of a head and back rest 14 and a trunk and foot rest 15. In one embodiment the head and back rest 14 comprise a tubular frame hinged to the head end upright 4 in block 16 bolted to upright 4 and backup plate 17. The block 16 also serves to support the tub pivot 2 with backup plate 17 in the same manner as at the foot end shown in detail in FIG. 6. The tubular frame of the trunk and foot rest 15 is hinged to the foot end upright 5 in block 19 bolted to backup plate 20. Hook plates 21 on the trunk and foot rest engage bar 21A to electively join the trunk and foot rest 15 to the back and head rest 14 allowing one to separate the two rests and swing them in the direction of the arrows 14A and 15A for cleaning the tub 1 and rests 14 and 15 as seen in FIG. 3. In all positions the rests 14 and 15 are clear of the ends 9 and 10 of the tub.

A spring biased latch 22 engages the front wall 11 of the tub when the front side is lowered as in FIG. 1. Since the tub 1 is semi-cylindrical, when the tub 1 is tilted so as to lower the front side 11 about the central axis of the cylinder, or from the lowered position to the position where the rim of the tub 1 lies in a horizontal plane, the tub wall remains at a fixed distance from the body support platform 13. Thus by this arrangement, the bather is protected from being injured by pinching between the tub wall and the platform 13.

Figure 5:
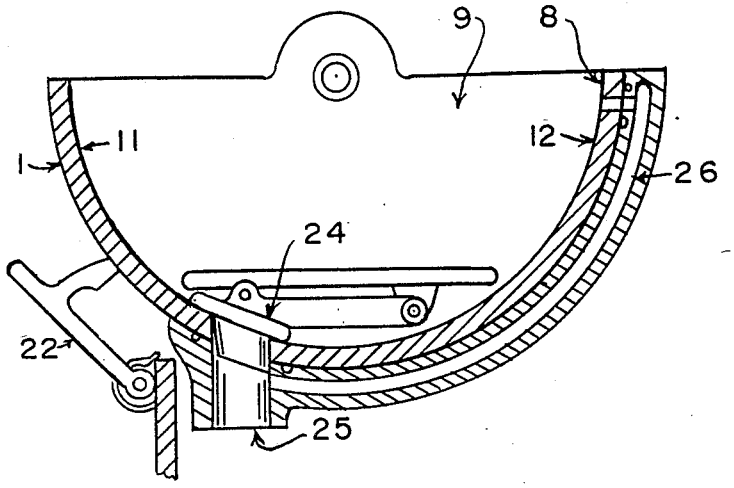
FIG. 5 is a sectional view on the line 5—5 of FIG. 4.
Figure 6:
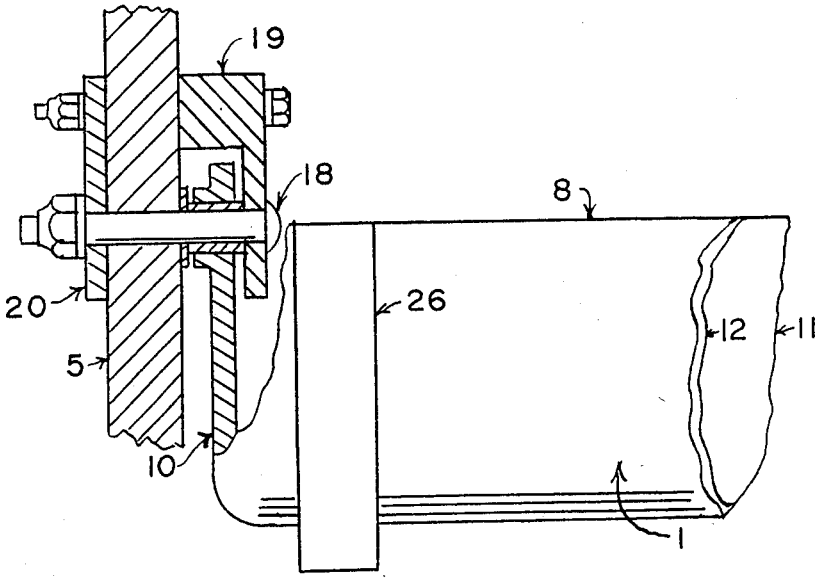
FIG. 6 is an elevation of the tub of FIG. 1–5 showing the left hand side of the foot of the tub with a partial sectional view of the pivot.

As shown in detail in FIG. 5, the stopper 24 when in the drain 25 serves as a safety lock preventing the tub 1 from rotating in relation to the drain 25 thus avoiding spillage of tub water. The stopper 24 can be opened and closed by linkage not shown. An overflow and drain vent 26 is a part of the drain assembly as seen in FIGS. 5 and 6.

A faucet assembly 27 with swing spout 28 is mounted on the back wall 7 of the bathing cabinet. The swing spout 28 may swing out of the way before tipping the tub 1 to allow the bather to get in and out of the tub 1.

It is to be noted that in this version of the invention, a semi-cylindrical shape is preferred because of the fixed distance between tub 1 and body support platform 13 which is maintained thereby. Other suitable shapes may of course be employed.

Figure 7:
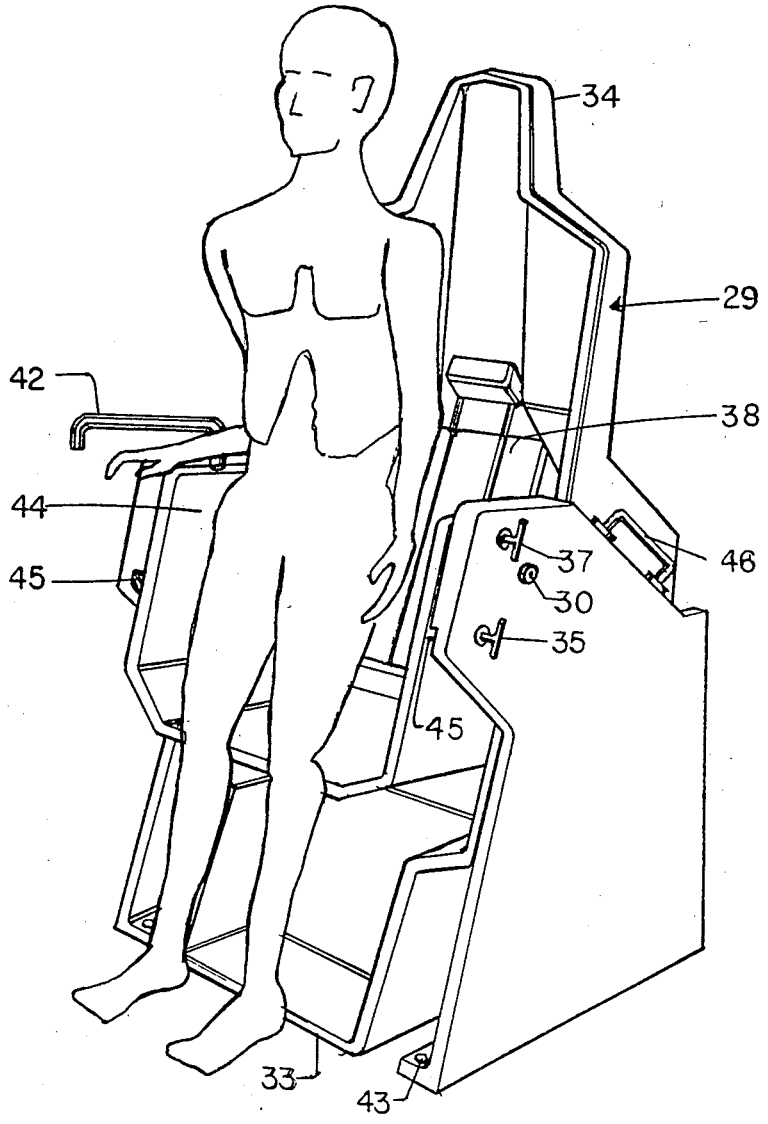
FIG. 7 is a perspective front view of another preferred embodiment of the bathing device of my invention having the tub pivots midway of the ends of the tub and showing the tub tipped into a near vertical position for entry and exit of the bather.
Figure 8:
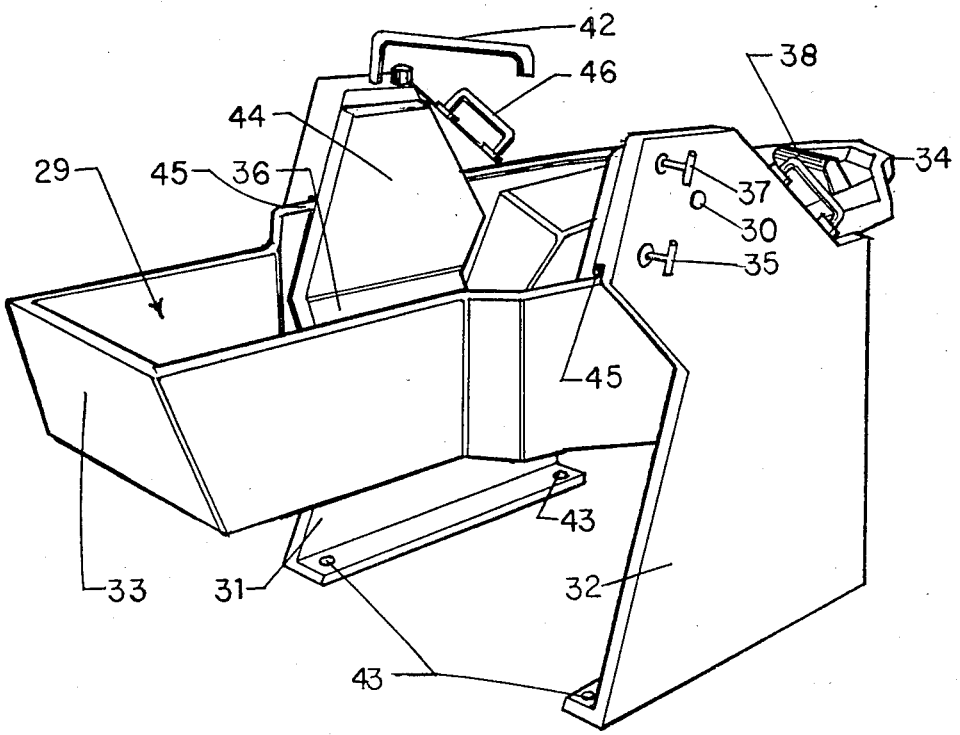
FIG. 8 is a perspective view of the bathing device of FIG. 7 with the tub in the horizontal position for bathing.
Figure 9:
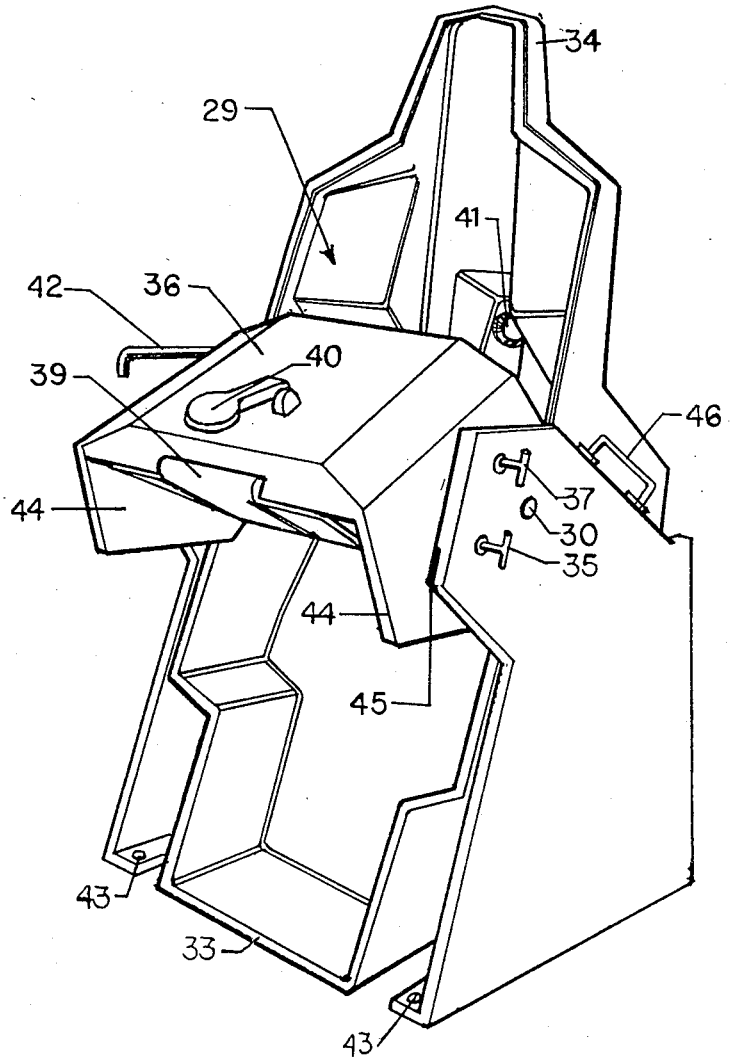
FIG. 9 is a perspective view of the bathing device of FIGS. 7 and 8 with the tub in horizontal position and the seat swung up for cleaning.

In another preferred embodiment of my invention shown in FIGS. 7–9 the tub 29 has a foot end 33 and a head end 34. The horizontal pivot axis for the tub 29 is midway of and transverse to the length of the tub 29. The optimum point for pivot 30 is near the vertical plane of the center of gravity (when the tub 29 is horizontal) to allow easy rotation of the tub 29 as in the manner of a balanced teeter totter. As in the version of FIGS. 1–6, the pivots 30 for the tub 29 are mounted on a pair of uprights 31 and 32. Thus the tub 29 can be tipped on its pivots 30 from a horizontal bathing position as in FIG. 8 to a bather access position as in FIG. 7 with the foot 33 of the tub 29 down at floor level and the head end 34 up. A spring pressed detent tub lock pin 35 mounted in one upright 32 engages recesses (not shown) in the side wall of the tub 29 to lock the tub 29 in either the tipped or horizontal position.

The body support in this version consists of a chair seat 36 pivotably fastened to uprights 31 and 32 and selectively locked in the bather support position of FIG. 7 and 8. Alternatively it may be rotated forward to the cleaning position as in FIG. 9 and locked by a spring pressed chair lock pin 37 which engages recesses (not shown) in the sidewall of the chair seat 36. A chair back 38 is attached by hinge 39 to the back of the chair seat 36. As best seen in FIG. 9, the drain stopper 40 is pivotably mounted on the bottom of chair seat 35 and is operated by linkage not shown to open or close drain 41 when the tub 29 is iun the horizontal position of FIG. 8 for bathing.

The faucet and swing spout 42 are mounted on the right hand upright 31 allowing for swinging the spout 42 out of the way of the bather when the tub 29 is tipped as in FIG. 7. As in the other version of FIGS. 1–6, the uprights 31 and 32 may be joined with a base (not shown) or attached to the floor of the bathroom as a base with bolts 43.

Because the tub 29 of the version of FIGS. 7–9 is configured so that it will not interfere with the seat 36 throughout the arc of tipping, it is not necessary that this tub 29 be semi-cylindrical as the sidewalls 44 of the seat 36 guard the bather from being pinched or injured in any way by relative motion of the tub 29 and seat 36. His feet simply ride up and down on the foot end of the tub with the tipping motion, and his back is supported by the back rest 38 which merely changes angle with the chair seat 36 with differences in tip angle. In some instances safety booting of some sort will cover the gap 45 to protect careless placing of hands therein.

It can be seen that both versions of my bathing device allow the bather to place his body in the bathing device in a manner which is as easy and safe for him as getting into a bed as in the version of FIGS. 1–6 or as sitting down on a reclining chair as in the version of FIGS. 7–9. Because the tub 1 or 29 is suspended on pivots midway of its length or width and in the vertical plane of its center of gravity when the tub is horizontal, it is as easily rotated or tipped as a teeter totter board by the bather with no need for personal assistant, motor, jack, hydraulic cylinder or mechanical leverage system. The stable position of the body support platforms 13 and 36 provide the bather with a base against which he pushes to move the tub 1 or 29. All he needs to do is swing the longitudinally pivoted tub 1 with his hands or the transverse pivoted tub 29 with his back and/or feet. Because the body support platform 13 of the longitudinally pivoted tub 1 of FIGS. 1–6 does not rest on the tub 1, there is no rubbing friction between the tub 1 and rest 13 to mar the tub or add to the force required to swing the tub 1. The main support for the bather's body in the version of FIGS. 7–9 is a chair seat which is completely clear of the tub 29. Nevertheless the chair back can be used to tip the tub 29 into a horizontal position. Handles 46 attached to the uprights 31 and 32 are available to the bather so that he may pull himself up from a reclining position, removing his weight from the chair back 38 and the head end 34 of the tub 29. After sitting up, the bather can open the stopper 40, drain the tub 29, release the lock pin 35 and then tip the tub 29 up to the access position shown in FIG. 7 by pressing with his feet against the bottom of the tub 29.

The embodiments described above and illustrated in the drawings are, of course, to be regarded merely as non-limiting examples and as to their details may be modified in several ways within the scope of the following claims.

What is claimed is:

1. A bathing device having a tub which may be tilted to a non-use position about a horizontal axis to raise and lower one side for safe and easy access by the bather comprising a bathtub having two opposed upstanding walls, an upright member located adjacent each of said opposed walls, a pivot member attached to each upright member and engaging the adjacent tub wall to allow said tub to tilt on said pivot about said horizontal axis above the center of gravity of said tub, a body rest platform within the tub mounted on at least one of said pivots for rotating movement from a non-use position to a use in-tub position and vice versa, said use position being such that the user can gain lateral access to said body rest platform without the hindrance of a tub wall when said tub is tilted to its non-use position and when said tub is in a use position said body rest platform will provide support for user without said body rest platform contacting said tub and in a non-use position said body rest platform is moved away from said tub for tub cleaning.

2. A bathing device as in claim 1 wherein the opposed upstanding walls are the sides of the tub.

3. The bathing device of claim 1 having its sides longer than its ends wherein the upstanding walls are the ends of the tub.

4. A bathing device as in claim 1 wherein the tub is generally in the shape of a long semi-cylinder and the pivot axis is substantially co-axial with the cylinder from which the semi-cylinder was generated whereby the distance between the body rest platform and the inside surface of the tub will remain nearly constant throughout the tilting of the tub.

5. The bathing device of claim 1 wherein the body rest platform comprises a head portion and a foot portion electively joined where adjacent, said portions each being supported from the pivot with a hinge to enable the portions of the rest platform to be separated and raised for cleaning.

* * * * *